US007048507B2

(12) United States Patent
Wettstein et al.

(10) Patent No.: US 7,048,507 B2
(45) Date of Patent: May 23, 2006

(54) AXIAL-FLOW THERMAL TURBOMACHINE

(75) Inventors: Hans Wettstein, Fislisbach (CH); Mohamed Yousef Nazmy, Fislisbach (CH); Claus Paul Gerdes, Rütihof (CH)

(73) Assignee: ALSTOM Technology Ltd., Baden (CH)

( * ) Notice: Subject to any disclaimer, the term of this patent is extended or adjusted under 35 U.S.C. 154(b) by 105 days.

(21) Appl. No.: 10/808,492

(22) Filed: Mar. 25, 2004

(65) Prior Publication Data

US 2006/0073019 A1 Apr. 6, 2006

(30) Foreign Application Priority Data

Mar. 26, 2003 (DE) ..... 103 13 489

(51) Int. Cl.
*F01D 5/14* (2006.01)

(52) U.S. Cl. ..... 416/203; 416/215; 416/241 R

(58) Field of Classification Search ..... 416/175, 416/203, 241 R, 215–218
See application file for complete search history.

(56) References Cited

U.S. PATENT DOCUMENTS 2,948,506 A 8/1960 Glasser et al.
3,664,766 A * 5/1972 Rahnke ..... 416/244 R
4,878,810 A * 11/1989 Evans ..... 416/203
5,008,072 A * 4/1991 Siga et al. ..... 420/69
5,474,421 A * 12/1995 Rossmann ..... 416/203
5,551,840 A * 9/1996 Benoit et al. ..... 416/241 B
5,741,119 A * 4/1998 Heppenstall ..... 416/219 R

FOREIGN PATENT DOCUMENTS

| | | |
|---|---|---|
| DE | 469 002 | 11/1928 |
| DE | 43 24 960 A1 | 1/1995 |
| DE | 44 39 726 A1 | 5/1996 |
| DE | 101 10 102 A1 | 8/2002 |
| EP | 0 513 407 B1 | 7/1995 |
| JP | 59150903 A | 8/1984 |
| WO | 99/27234 | 6/1999 |

OTHER PUBLICATIONS

Search Report from DE 103 13 489.1 (Aug. 22, 2003).

* cited by examiner

*Primary Examiner*—Edward K. Look
*Assistant Examiner*—Devin Hanan
(74) *Attorney, Agent, or Firm*—Cermak & Kenealy, LLP; Adam J. Cermak

(57) ABSTRACT

The invention relates to an axial-flow thermal turbomachine having a metallic rotor (1), in which rotor blades (3) made of an intermetallic compound are mounted in a circumferential groove to form a row of blades. The invention is characterized in that at least two rotor blades (3') which are at a uniform distance from one another and are made of a more ductile material are arranged in the said row of blades between the intermetallic rotor blades (3), the rotor blades (3') made of the more ductile material either being considerably longer than the intermetallic blades (3) or, if they are of the same length, having a different blade tip shape than the intermetallic blades (3).

9 Claims, 2 Drawing Sheets

AXIAL-FLOW THERMAL TURBOMACHINE

BACKGROUND OF THE INVENTION

1. Field of the Invention

The invention deals with the field of power plant technology. It relates to an axial-flow thermal turbomachine which has a reduced rotor weight compared to the known prior art.

2. Discussion of Background

Thermal turbomachines, e.g. high-pressure compressors for gas turbines or turbines, substantially comprise a rotor fitted with rotor blades and a stator, in which guide vanes are mounted. The rotor blades and guide vanes each have a main blade section and a blade root. To enable the blades and vanes to be secured to the rotor or in the stator, grooves are formed in the stator and on the rotor shaft. The roots of the guide vanes and rotor blades are pushed into these grooves and then held in place.

The stationary guide vanes serve the purpose of diverting the flow of the gaseous medium which is to be compressed or expanded onto the rotating rotor blades in such a way that the energy is converted with optimum efficiency.

It is known to produce blades and vanes integrally from a single material, e.g. from stainless steel for gas turbine compressors or from a nickel-base superalloy for gas turbines and to use these identical blades or vanes to produce a row of blades or vanes. Blades or vanes of this type are referred to below as conventional blades.

For certain applications, the mean mass of a row of blades is limited by the load-bearing capacity of the rotor.

Therefore, there are known solutions for producing blades in a hybrid form. In the case of the hybrid form, different materials with different physical properties are combined with one another to produce a blade in order to obtain an optimum blade design. For example, a hybrid rotor blade for an engine, in which the trailing edge of the main blade section, which has only an aerodynamic function, is made of a lightweight material, preferably a fiber composite material, e.g. carbon fiber composite material, is known from DE 101 10 102 A1. A (lightweight) trailing edge of this type advantageously makes it possible to reduce the weight of the blade. The two parts of the main blade section (heavy metallic leading edge and lightweight trailing edge made of fiber composite material) are joined by adhesive bonding or riveting.

A similar solution is described in WO 99/27234, which discloses a rotor with integral blading, in particular for an engine, on the circumference of which rotor blades are arranged, the rotor blades, in order to reduce vibrations, having a metallic blade root, a metallic main blade section, which forms at least part of the blade leading edge and of the adjoining region of the blade surface, and a main blade section made of fiber-reinforced plastic. In this case too, the main blade section made of plastic is secured to the metallic part of the main blade section by adhesive bonding/riveting or by means of a clamp fit.

This known prior art has the drawbacks listed below. Firstly, the abovementioned forms of attachment are unable to withstand high loads over the course of a prolonged period of time, and secondly the fiber-reinforced plastics can only be used in certain temperature ranges, and consequently these known technical solutions are only suitable in particular for engine technology. Moreover, the characteristics of the main blade section (mechanical properties, resistance to oxidation, frictional properties) are altered compared to those of the main blade sections which consist of a single material, and this can have an adverse effect on the operating performance of the engine.

Furthermore, EP 0 513 407 B1 has disclosed a turbine blade made of an alloy based on a dopant-containing gamma-titanium aluminide, which comprises main blade section, blade root and if appropriate blade covering strip. During production of this blade, the casting is partially heat-treated and hot-formed in such a manner that the main blade section then has a course-grained structure, which leads to a high tensile strength and creep rupture strength, and that the blade root and/or the blade cover strip has a fine-grain structure, which leads to an increased ductility compared to the main blade section.

Although the use of these blades consisting of gamma-titanium aluminide advantageously reduces the mass of the rotor compared to conventional blades, a drawback of this prior art is that the blade tips, on account of their brittleness, flake off when they come into contact with the stator during operation. However, it is not normally possible to prevent this friction.

Experience gained with steel blades in high-pressure compressors has shown that even with what are known as abradable layers on the stator, the blade tips of the rotor blades can become ground down while the compressor is operating. This entails a considerable frictional force, which leads to brittle blade fracture if the blade is not ductile.

SUMMARY OF THE INVENTION

Accordingly, one aspect of the invention includes avoidance of the abovementioned drawbacks of the prior art. An aspect of the invention includes developing a thermal turbomachine which is distinguished, on the one hand, by a reduced overall weight of the rotor and in which, on the other hand, brittle blade fracture is prevented, so that the service life of the turbomachine is extended.

According to the principles of the present invention, in the case of an exemplary thermal turbomachine, at least two blades are at a uniform distance from one another and are made of a more ductile material, and are arranged in a row of blades between the intermetallic blades, the blades made of the more ductile material either being considerably longer than the intermetallic blades or, if they are of the same length, having a different blade tip shape than the intermetallic blades.

Advantages of the invention can include that, firstly, the weight of the rotor is reduced by the use of the blades made of intermetallic compounds, which leads to an increase in the service life of the rotor/blade connection, and, secondly, the brittleness of the intermetallic blades does not entail any increased risk when the turbomachine is operating, since the blades made of the more ductile material arranged in the same row of blades absorb the frictional/wearing forces.

It is expedient, if, in addition, intermediate pieces made of a more lightweight material than the rotor material, preferably an intermetallic compound or a titanium alloy, are additionally arranged in the rotor between the rotor blades of a row of blades. In this way, the weight of the rotor is additionally reduced.

Furthermore, it is advantageous if the intermetallic blades and the intermediate pieces consist of an intermetallic $\gamma$-TiAl compound or an intermetallic orthorhombic TiAl compound, since this use of materials in accordance with the invention leads to a considerable reduction in the weight of the rotor. The relative density of the intermetallic titanium aluminide compounds is, for example, only approximately 50% of the density of stainless Cr—Ni—W steel.

Finally, it is advantageous if the blade tips are coated with a hard phase or a wear-resistant layer is applied by means of laser welding, in order to prevent the blade tips from being ground down and/or to reduce the frictional force.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
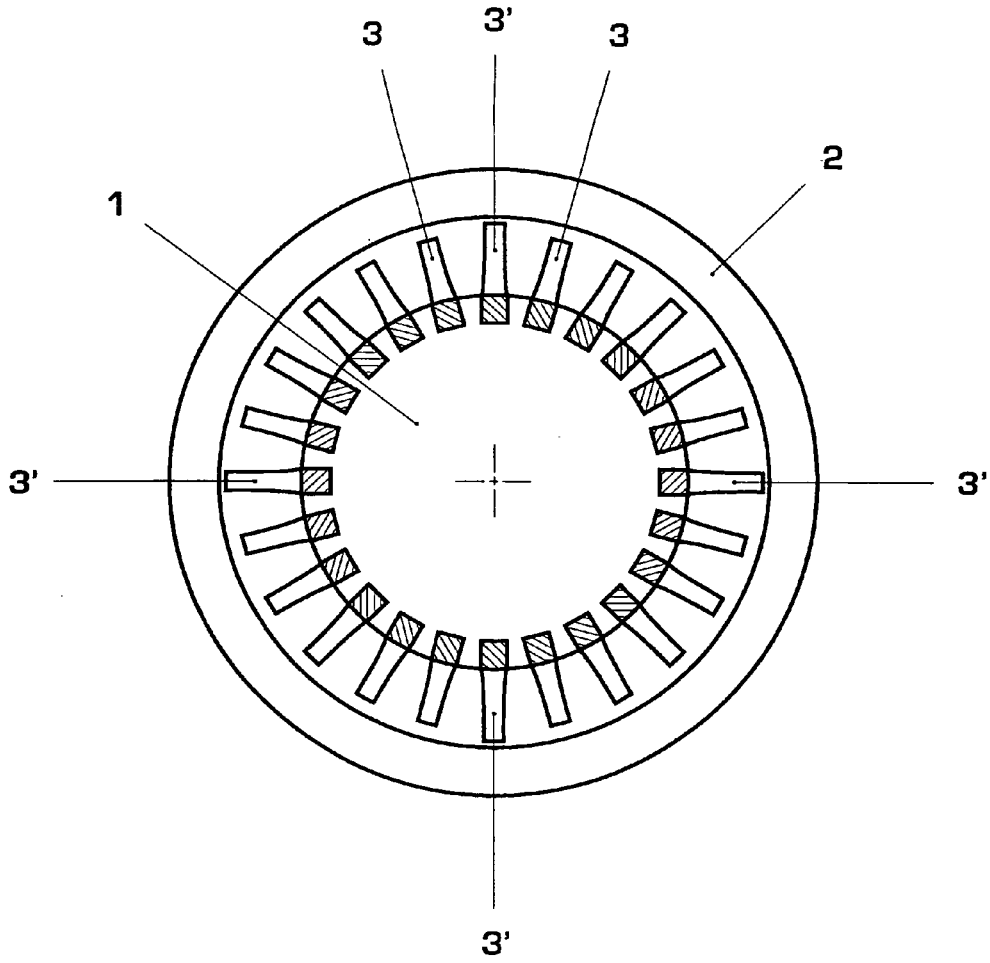
FIG. 1 shows a cross section through a row of rotor blades belonging to a diagrammatically depicted high-pressure compressor according to the invention in a first variant embodiment.

Referring now to the drawings, wherein like reference numerals designate identical or corresponding parts throughout the several views, FIG. 1 shows a cross section through a diagrammatically depicted row of rotor blades belonging to a rotor 1 for a high-pressure compressor of a gas turbine. The rotor 1 is surrounded by a stator 2. Rotor blades 3, 3' are mounted in a circumferential groove in the rotor 1, while guide vanes (not shown here) are secured in the stator 2. The blades 3, 3' are, for example, exposed to a pressure of approx. 32 bar and a temperature of approx. 600° C. for several thousand hours.

According to the invention, the row of blades illustrated is fitted with two different types of rotor blades 3, 3'. To reduce the weight, the majority of the rotor blades, namely the rotor blades 3, are made of an intermetallic compound, preferably a γ-titanium aluminide compound. The rotor blades 3', by contrast, are made of a material, for example a stainless Cr—Ni steel, which is more ductile than the material of the rotor blades 3. At least two more ductile blades 3 of this type, which are at a uniform distance from one another (in FIG. 1, there are four such blades in this exemplary embodiment), are arranged in the row of blades comprising the intermetallic blades 3. In this exemplary embodiment, the blades 3' made of the more ductile material are significantly longer than the intermetallic blades 3, i.e. in the event of undesirable contact between the blades and the stator during operation, these more ductile blades can absorb the frictional forces without any brittle fracture occurring. In another variant embodiment, it is also possible, in order to achieve the same effect, for both types of blades 3, 3' to be of the same length, but to have different shapes of blade tip 5, for example for the more ductile blades 3' advantageously to have truncated or blunted blade tips 5.

In the present exemplary embodiment, the rotor blades 3' consist of a stainless steel of the following chemical composition (in % by weight): 0.12 C, <0.8 Si, <1.0 Mn, 17 Cr, 14.5 Ni, <0.5 Mo, 3.3 W, <1 Ti, <0.045 P, <0.03 S, remainder Fe. The shaft of the rotor 1 likewise consists of steel. The density of steel is known to be approx. 7.9 g/cm$^3$. The intermetallic compound of which the rotor blades 3 are made has the following chemical composition (in % by weight): Ti-(30.5–31.5)Al-(8.9–9.5)W-(0.3–0.4)Si. The density of this alloy is advantageously only 4 g/cm$^3$ and consequently the rotor 1 according to the invention is significantly more lightweight than a rotor comprising exclusively conventional steel blades.

Figure 2:
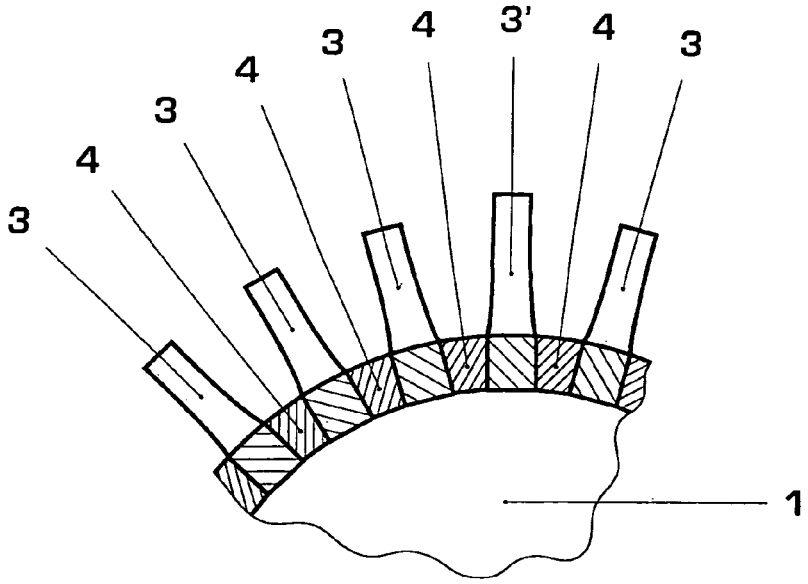
FIG. 2 shows a detail of a second variant embodiment of the invention, in which intermediate pieces made of intermetallic compounds are arranged in the rotor between the rotor blades.

FIG. 2 shows a detailed illustration of a further exemplary embodiment of the invention. The weight of the rotor 1 can be additionally reduced if—as illustrated in FIG. 2—intermediate pieces 4 made of an intermetallic compound, in this case of a γ-titanium aluminide compound, are mounted in the circumferential groove in the rotor 1 between two adjacent rotor blades of a row of blades belonging to the rotor 1.

The intermetallic compound used to produce the intermediate pieces 4 has the same chemical composition as the compound which is used for the blades 3 and is described above.

Intermetallic compounds of titanium with aluminum have a number of advantageous properties which makes them appear attractive as structural materials in the medium and relatively high temperature ranges. These include their lower density compared to superalloys and compared to stainless steels. However, their brittleness is often an obstacle to their technical use in their current form.

The above-described intermetallic γ-titanium aluminide compound is distinguished by a density which is approximately 50% lower than that of the steel used for the rotor 1 and the blades 3' in this exemplary embodiment. Furthermore, it has a modulus of elasticity at room temperature of 171 GPa and a thermal conductivity λ of 24 W/mK.

Table 1 compares the physical properties of the two alloys.

TABLE 1 physical properties of the various materials

| | Density in g/cm$^3$ | Coefficient of thermal expansion in K$^{-1}$ |
|---|---|---|
| γ-Ti-Al | 4 | $10 \times 10^{-6}$ |
| Stainless steel | 7.9 | $18.6 \times 10^{-6}$ |

Table 1: Physical Properties of the Various Materials

Since the rotating components of the high-pressure compressor of a gas turbine installation are subject to high thermal loads at temperatures of up to approx. 600° C., the reduction in the weight of the rotor 1 according to the invention has the advantageous effect of increasing the service life of the turbomachine. The stresses in the blade root fixing in the rotor 1 are reduced.

The intermetallic blades 3 and the intermediate pieces 4 are produced in a known way by casting, hot isostatic pressing and heat treatment with minimal remachining.

Figure 3:
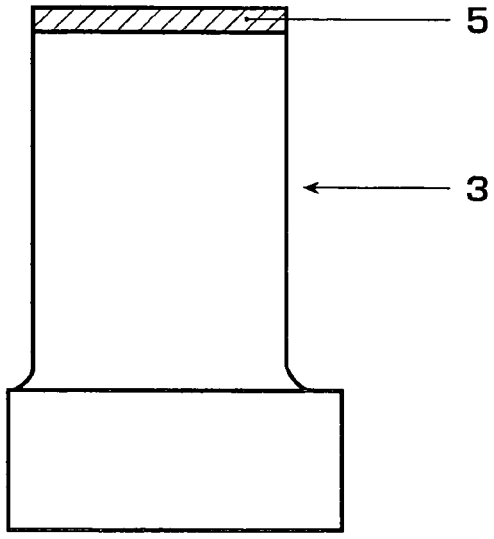
FIG. 3 shows a TiAl blade with a coated blade tip as a third variant embodiment of the invention.

FIG. 3 shows a further preferred variant embodiment. This figure illustrates a rotor blade 3 with a coated blade tip 5. The blade tip may be coated with a hard phase, or alternatively a wear-resistant layer may be applied by means of laser welding. In both cases, the blade tips are prevented from being ground down and/or the frictional force is reduced.

Of course, the invention is not restricted to the exemplary embodiments illustrated.

For example, it is also possible for an orthorhombic titanium aluminide alloy with a density of 4.55 g/cm$^3$ to be used as material for the intermetallic blades 3 and/or the intermediate pieces 4. Orthorhombic titanium aluminide alloys are based on the ordered compound $Ti_2AlNb$ and have the following chemical composition (in % by weight): Ti-(22–27)Al-(21–27)Nb.

The intermediate pieces 4 may also be made of a less expensive titanium alloy rather than an intermetallic γ-titanium aluminide compound, although in this case the weight reduction is not as great.

Furthermore, it is conceivable for the invention to be used not only for high-pressure compressor rotors but also for turbine rotors with turbine blades made of known turbine steel, heat-resistant steel or of a superalloy, for example a nickel-based superalloy, in which the intermediate pieces between the rotor blades consist, for example, of an intermetallic γ-titanium consist, for example, aluminide alloy or an intermetallic orthorhombic titanium aluminide alloy. This too advantageously makes it possible to achieve reductions in weight and an increase in the service life of the turbomachine.

The brittleness of the intermetallic Ti—Al alloys has no adverse effect for the use of these materials in accordance with the invention as described above, since, when used as intermediate pieces, they are not exposed to any abrasive contact or frictional wear, and when used as blades the corresponding more ductile blades absorb the frictional/wearing forces.

Obviously, numerous modifications and variations of the present invention are possible in light of the above teachings. It is therefore to be understood that within the scope of the appended claims, the invention may be practiced otherwise than as specifically described herein.

| LIST OF DESIGNATIONS | |
|---|---|
| 1 | Rotor |
| 2 | Stator |
| 3, 3' | Rotor blade |
| 4 | Intermediate piece |
| 5 | Blade tip |

The invention claimed is:

1. An axial-flow thermal turbomachine comprising:

a metallic rotor;

a circumferential groove;

rotor blades made of an intermetallic compound mounted in the circumferential groove to form a row of blades;

at least two rotor blades positioned at a uniform distance from one another and made of a material more ductile than said intermetallic compound, said at least two rotor blades arranged in said row of blades between the intermetallic rotor blades;

wherein said at least two rotor blades are either longer than the intermetallic rotor blades, or the same length as and have a different blade tip shape than the intermetallic rotor blades.

2. The turbomachine as claimed in claim 1, further comprising:

intermediate pieces made of a more lightweight material than the material of the rotor arranged between two adjacent rotor blades of a row of blades.

3. The turbomachine as claimed in claim 2, wherein the intermetallic compound of the rotor blades and the lightweight material of the intermediate pieces each comprises an alloy selected from the group consisting of a γ-titanium aluminide alloy and an orthorhombic titanium aluminide alloy.

4. The turbomachine as claimed in claim 3, wherein the γ-titanium aluminide alloy has the following chemical composition (in % by weight): Ti-(30.5–31.5)Al-(8.9–9.5)W-(0.3–0.4)Si.

5. The turbomachine as claimed in claim 2, wherein said lightweight material comprises an intermetallic compound or a titanium alloy.

6. The turbomachine as claimed in claim 1, wherein the rotor blades comprise blade tips coated with a hard phase.

7. The turbomachine as claimed in claim 6, wherein the blade tips each comprise a wear-resistant layer laser welded to the blade tips.

8. The turbomachine as claimed in claim 1, wherein the turbomachine comprises a gas turbine having a high-pressure compressor comprising said rotor, said rotor comprising a stainless Cr—Ni steel.

9. The turbomachine as claimed in claim 1, wherein said rotor blades comprise a material selected from the group consisting of stainless Cr—Ni steel, a heat-resistant turbine blade steel, and a superalloy.

* * * * *